United States Patent [19]

Kasprzak

[11] Patent Number: 4,712,351

[45] Date of Patent: Dec. 15, 1987

[54] VINYL SIDING

[75] Inventor: David P. Kasprzak, St. Petersburg, Fla.

[73] Assignee: The Celotex Corporation, Tampa, Fla.

[21] Appl. No.: 929,117

[22] Filed: Nov. 10, 1986

[51] Int. Cl.[4] ..... E04C 1/06

[52] U.S. Cl. ..... 52/573; 52/547; 52/549

[58] Field of Search ..... 52/527, 522, 542, 545, 52/547, 551, 552, 1, 573, 546, 549, 543

[56] References Cited

U.S. PATENT DOCUMENTS

| | | | |
|---|---|---|---|
| 1,259,914 | 3/1918 | Seward et al. . | |
| 2,421,407 | 6/1947 | Bowman | 52/546 |
| 2,766,861 | 10/1956 | Abramson | 189/86 |
| 2,811,118 | 10/1957 | Ball | 108/17 |
| 3,159,943 | 12/1964 | Sugar et al. | 50/200 |
| 3,233,382 | 2/1966 | Graveley, Jr. | 52/522 |
| 3,274,743 | 9/1966 | Blum, Jr. | 52/539 |
| 3,282,009 | 11/1966 | Chalmers | 52/543 |
| 3,376,683 | 4/1968 | Epstein | 52/521 |
| 3,473,274 | 10/1969 | Godes | 52/127 |
| 3,504,467 | 4/1970 | Hatch, Jr. et al. | 52/309 |
| 3,520,099 | 7/1970 | Mattes | 52/531 |
| 3,552,078 | 1/1971 | Mattes | 52/520 |
| 4,104,841 | 8/1978 | Naz | 52/519 |
| 4,186,538 | 2/1980 | Marcum, Jr. | 52/521 |
| 4,327,528 | 5/1982 | Fritz | 52/539 |
| 4,334,396 | 6/1982 | Hagopian | 52/522 |
| 4,435,933 | 3/1985 | Krowl | 52/309 |
| 4,450,665 | 5/1984 | Katz | 52/522 |

*Primary Examiner*—Carl D. Friedman

*Attorney, Agent, or Firm*—James W. Grace; Charles W. Vanecek

[57] ABSTRACT

This invention relates to siding panel units in which an area near fastener receiving slots has an isolation means disposed in a U-shaped configuration partially around at least some of said fastener receiving slots and said isolation means comprises vertical stress relief means at each side of at least some of said fastener receiving slots and an elongated slot lying below corresponding ones of said fastener receiving slots and spanning the distance between said vertical stress relief means.

4 Claims, 4 Drawing Figures

VINYL SIDING

BACKGROUND OF THE INVENTION

1. Field of the Invention

This invention relates to the field of siding panel assemblies and more particularly to siding panels which are attached to a building to form the exterior surface thereof.

2. Description of the Prior Art

Building siding units have previously been formed from thin plastic sheet material which can have a variety of colors and which is substantially maintenance free and of long life. Also, siding units have been made of metal sheets. However, siding units formed from plastic or metal sheet material is subject to expansion and contraction which occurs with changes in ambient temperature. Expansion of the building siding units between nailing points will cause buckling and distortion of the thin sheet material. The siding unit must be designed so as to compensate for the varying rates of expansion and contraction regardless of the tightness of the fasteners which secure the siding unit to the building.

Siding units must be securely fastened to the building structure, yet be loose enough to allow for normal expansion and contraction without distorting the siding units. Driving nails with a hammer requires skill and conscious effort to ensure a properly driven fastener. Experience has shown highly variable results and generally overdriven fasteners. Also variable results in achieving a properly driven fastener are found even with pneumatic guns because of varying density in the underlying substrate.

Various means have been tried in the past to provide for the expansion and contraction of the siding unit. For example, U.S. Pat. No. 4,435,933 describes rigid clips, having an upper hanger portion and a lower channel formed to grasp the common elongate protrusions formed along the top edge of extruded vinyl siding, which support the siding while permitting it to expand and contract freely with changes in temperature. U.S. Pat. No. 3,552,078 illustrates a building siding unit attachment arrangement which requires a separate attachment strip to engage a retainer means of a face panel to support the panel and to permit free relative longitudinal movement between the attachment strip and the panel. U.S. Pat. No. 3,504,467 illustrates a siding panel which has a fastening flange of concave configuration in cross section to prevent and discourage the overdriving of the nail or securing means when installing the panel. The elimination of overnailing coupled with the elongated configuration of the nailing apertures allows the siding panels to slide on nails without undue restriction in their horizontal movement after installation.

SUMMARY OF THE INVENTION

The invention relates to a siding unit which is designed to compensate for the thermal expansion and contraction caused by changes in ambient temperature.

Accordingly, it is an object of the present invention to provide a novel siding unit which compensates for expansion and contraction.

It is another object of the present invention to provide a novel siding unit which compensates for expansion and contraction in a simple and economical manner.

It is yet another object of the present invention to provide a novel siding unit which compensates for expansion and contraction of the siding unit without regard for the tightness of the fasteners.

These and other objects and advantages of the present invention will become apparent to those skilled in the art from a consideration of the following detailed description of the invention taken in conjunction with the accompanying drawing in which like numbers indicate like elements and which:

FIG. 1 is an isometric rear view of a section of wall siding panel of the invention, FIG. 2 is an enlarged, fragmentary sectional view showing the siding panel installed, FIG. 3 is an enlarged fragmentary elevational view of the siding panel of FIG. 1 of the invention, and FIG. 4 is a fragmentary perspective view of an alternative version of the siding panel of the invention.

DESCRIPTION OF THE PREFERRED EMBODIMENTS

Figure 1:
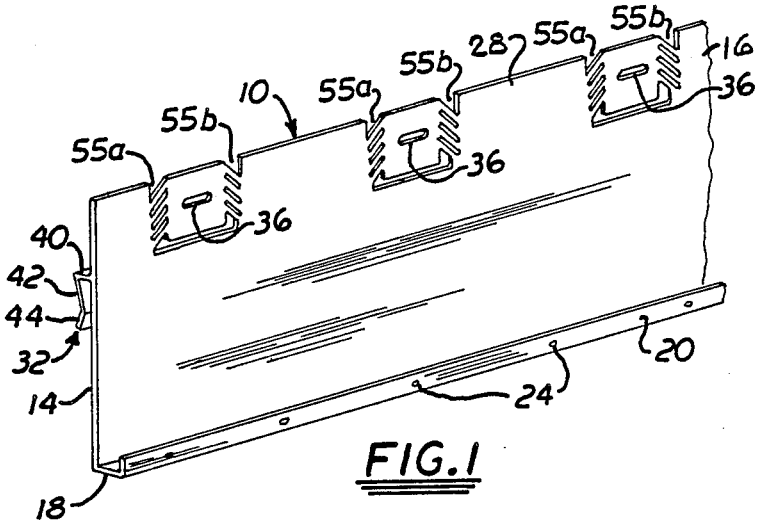

Referring now to the drawings in detail and particularly to FIG. 1, there is shown a siding panel 10 made generally of a relatively thin sheet of vinyl. Panel 10 is produced by extruding elongate integral sections of about 10 to 20 feet in length having a shape to simulate a wood lap siding. Panel 10 includes a main portion 14, a top concealed portion 16, a bottom perpendicular spacer flange 18, and at the outermost end thereof, an upwardly extending short interlock flange 20. At spaced invervals along the interior facing edge of interlock flange 20 are a series of dimples or protrusions 24 which serve to further interlock interlock flange 20 with a mating attachment portion of a panel forming the next higher course of siding.

The top concealed portion 16 includes an upper attachment portion 28 and an interlock receiver channel 32, opening downwardly for the reception of interlock flange 20 of the siding section 14 located immediately thereabove.

The attachment portion 28 includes a plurality of spcaed apart, longitudinally aligned, horizontally elongated nailing slots 36 and notches **55*a* and 55*b***.

The interlock receiver channel 32 is formed of an "h" section in which one side is formed by a wall of top concealed portion 16, a short horizontal flange 40 extending outwardly of the face of top concealed portion 16 and a downwardly and inwardly directed flange 42 integrally connected along the edge of horizontal flange 40 and extending back toward and adjacent to the face of top concealed portion 16. The lower edge of flange 42 has a short flange 44 which is bent away from the face of top concealed portion 16 to form an entry for the reception of interlock flange 20 of the panel 14 which forms the next higher course of panels.

Figure 2:
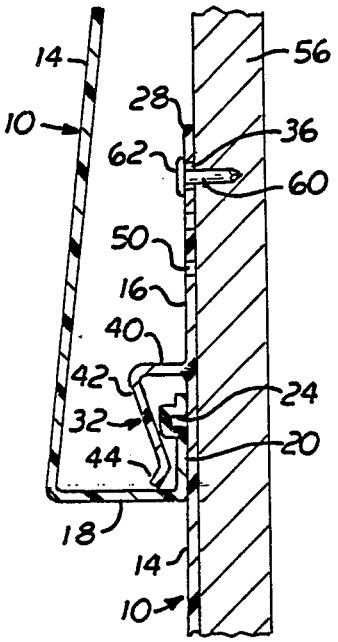

For an illustration of the method of fastening panel 10 to framing member 56, reference may be had to FIG. 2.

To secure panel 10 to framing member 56, a number of fasteners 60 are driven through slots 36. The heads 62 of fastener 60 are larger than the width of slots 36 so that panel 10 is fastened to framing member 56. Fasteners 60 may be nails or similar fastening means.

Because fasteners 60 may be overdriven and hold the concealed portion 16 of panel 10 so tightly against framing member 56, there may be no movement of panel 10 along its upper area to compensate for expansion or contraction because of temperature changes. To compensate for this deficiency and to ameliorate the effects of expansion or contraction of panel 10, thin strips 54 are provided to act as vertical stress relief means or isolation means to isolate the fastening function of fasteners 60 from the main portion 14 of panel 10.

Figure 3:
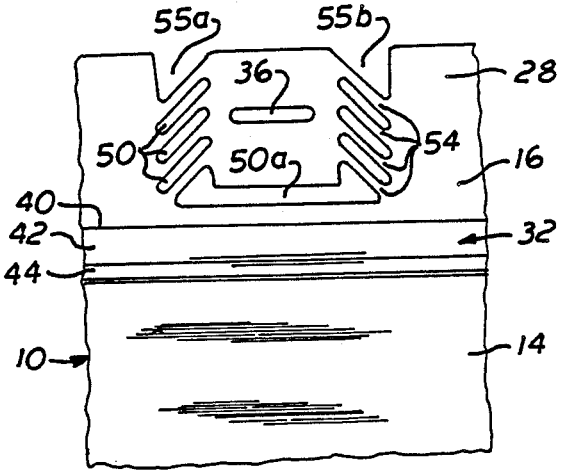

Reference may be had to FIG. 3 which is an enlarged fragmentary elevational view of the nailing slot 36 and the isolation means.

A series of separated slots 50 and an elongated slot 50*a* are located near nailing slot 36 to form a U-shaped isolation means surrounding the sides and bottom of nailing slot 36. The isolation means allows for expansion and contraction of the siding panel without distortion. The uncut areas 54 lying between slots 50 form a part of the isolation means. The preferred shape and arrangement of slots 50 are shown in FIG. 3 and consist of a pair of vertical rows of slots 50, each slot being cut at an angle with respect to nailing slot 36 and having each row on a respective side of nailing slot 36 with a horizontal slot 50*a* lying below and parallel to nailing slot 36. Horizontal slot 50*a* spans the distance between the vertical rows of slots 50. A pair of notches 55*a* and 55*b* are cut in the upper edge of attachment portion 28 and form the upper parts of the rows of isolation means. The purpose of notches 55*a* and 55*b* is to allow the isolation means to perform its relief function without having a fixed strengthened part all the way across the top of attachment portion 28.

The number, shape and area of slots 50 can be varied depending upon the nature of the sheet material of panel 10, the stiffness and thickness of the sheet material of panel 10 and the desired accommodation for expansion and contraction of panel 10.

Figure 4:
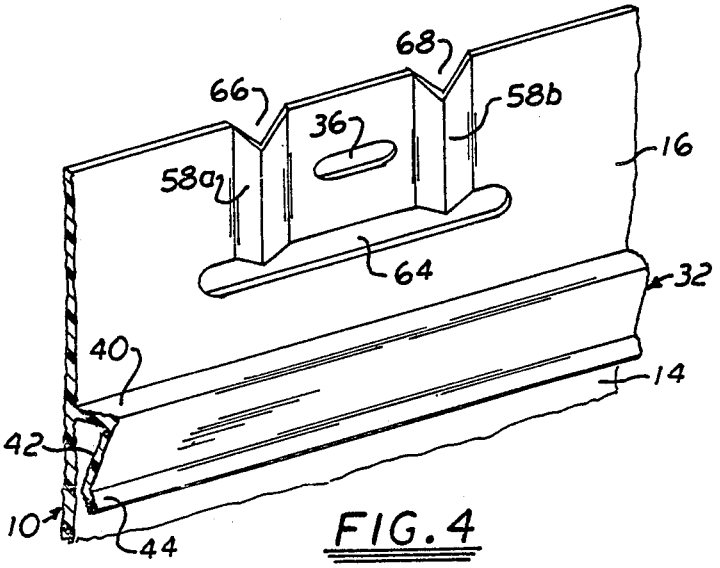

For an alternative version of the isolation means of the invention reference may be had to FIG. 4 which is a fragmentary view of another embodiment of the siding panel of this invention. Nailing slot 36 has a pair of weakened areas, one along each side thereof comprising creases or folds 58*a* and 58*b*. At the lower edge of the isolation means and connecting folds 58*a* and 58*b* is an elongated slot 64 which is parallel to nailing slot 36 and spans the distance between folds 58*a* and 58*b*. A pair of notches 66 and 68 are cut into the upper edge of panel 14. Folds 58*a* and 58*b* form flexible areas so that any tendency of the fastener 60 driven through nailing slot 36 to hold the panel 14 rigidly to the stud 56 is overcome. Of course, folds 58*a* and 58*b* may be multiple folds in the manner of an accordian, if desired.

It is not necessary that every nailing slot is encompassed by the weakened areas but that arrangement is preferable.

In summary the invention provides a panel which has weakened areas or isolation areas on each side of nailing slots to prevent distortion caused by expansion or contraction of the panel.

The present embodiments of the invention are illustrative and should not be considered as restrictive, the scope of the invention being indicated by the appended claims.

I claim:

1. In a building siding unit comprising a sheet having an upper portion having a plurality of spaced, horizontally elongated, aligned fastener receiving slots disposed therein, an interlock receiver channel disposed on said upper portion and spaced from said plurality of fastener receiving slots, the improvement comprising isolation means disposed in a U-shaped configuration partially around at least some of said aligned fastener receiving slots and in an area above said interlock receiver channel, said isolation means comprising vertical stress relief means at each side of at least some of said fastener receiving slots, said vertical stress relief means comprising a series of thin strips of said sheet and an elongated slot lying below corresponding ones of said fastener receiving slots and spanning the distance between said stress relief means, whereby said isolation means serves as a means to ameliorate the effects of expansion and contraction of said building siding unit caused by changing weather conditions.

2. In a building siding unit as recited in claim 1 in which said sheet is a vinyl plastic material.

3. In a building siding unit as recited in claim 1 in which said thin strips are formed by the sheet material left where a plurality of aligned slots are cut from the sheet material.

4. In a building siding unit as recited in claim 1 in which a pair of notches are cut into the upper edge of said sheet, each of said notches being aligned vertically with said vertical stress relief means.

* * * * *